US010648106B2

(12) United States Patent
Lecostaouec et al.

(10) Patent No.: US 10,648,106 B2
(45) Date of Patent: May 12, 2020

(54) SYSTEMS AND METHODS FOR REDUCED CRIMP CARBON FIBER HELICAL FABRIC

(75) Inventors: Jean-Francois Lecostaouec, Pueblo West, CO (US); Paul Perea, Pueblo West, CO (US)

(73) Assignee: GOODRICH CORPORATION, Charlotte, NC (US)

( * ) Notice: Subject to any disclaimer, the term of this patent is extended or adjusted under 35 U.S.C. 154(b) by 786 days.

(21) Appl. No.: 13/412,321

(22) Filed: Mar. 5, 2012

(65) Prior Publication Data

US 2013/0231024 A1 Sep. 5, 2013

(51) Int. Cl.

| | |
|---|---|
| ***D03D 15/00*** | (2006.01) |
| ***D03D 3/08*** | (2006.01) |
| ***D03D 49/20*** | (2006.01) |
| ***D03D 15/06*** | (2006.01) |

(52) U.S. Cl.

CPC ..... *D03D 15/0094* (2013.01); *D03D 3/08* (2013.01); *D03D 15/06* (2013.01); *D03D 49/20* (2013.01); *D10B 2101/12* (2013.01); *D10B 2201/02* (2013.01); *D10B 2201/04* (2013.01); *D10B 2201/20* (2013.01); *D10B 2211/02* (2013.01); *D10B 2211/04* (2013.01); *D10B 2321/022* (2013.01); *D10B 2321/10* (2013.01); *D10B 2331/02* (2013.01); *D10B 2331/04* (2013.01); *D10B 2401/063* (2013.01); *D10B 2403/02412* (2013.01); *D10B 2505/02* (2013.01); *Y10T 442/322* (2015.04); *Y10T 442/3244* (2015.04); *Y10T 442/3252* (2015.04)

(58) Field of Classification Search

CPC ..... D03D 3/00; D03D 15/0094; D03D 15/02; D03D 15/00

USPC ..... 442/203, 208, 209, 210, 211

See application file for complete search history.

(56) References Cited

U.S. PATENT DOCUMENTS

| | | | | | |
|---|---|---|---|---|---|
| 3,917,884 | A | * | 11/1975 | Jahn | 427/228 |
| 4,134,360 | A | * | 1/1979 | Fisher et al. | 118/728 |
| 4,273,160 | A | * | 6/1981 | Lowles | 138/124 |
| 4,320,160 | A | | 3/1982 | Nishimura et al. | |
| 4,506,611 | A | * | 3/1985 | Parker et al. | 112/80.01 |
| 4,748,996 | A | | 6/1988 | Combier | |
| 4,861,575 | A | * | 8/1989 | Levan | D01F 9/22 264/29.5 |
| 5,418,063 | A | * | 5/1995 | Booth | 428/408 |

(Continued)

FOREIGN PATENT DOCUMENTS

| | | |
|---|---|---|
| EP | 0489637 | 6/1992 |
| EP | 1357211 | 10/2003 |

(Continued)

OTHER PUBLICATIONS

Definition of "adjacent" https://www.dictionary.com/browse/adjacent. (Year: 2018).*

(Continued)

*Primary Examiner* — Andrew T Piziali

(74) *Attorney, Agent, or Firm* — Snell & Wilmer L.L.P.

(57) ABSTRACT

Systems and methods for weaving helical carbon fabrics with minimum fiber crimp are provided herein. In various embodiments, small denier natural or synthetic yarns are used in the warp direction to interlace the carbon fiber wefts with minimum deformation. Specific weave designs are used in combination with the small denier yarn to maintain the primary carbon fiber weft and warp un-crimped.

12 Claims, 5 Drawing Sheets

(56) References Cited

U.S. PATENT DOCUMENTS

| | | | | |
|---|---|---|---|---|
| 5,769,046 | A | 6/1998 | Ransone | |
| 5,876,322 | A | 3/1999 | Piramoon | |
| 5,952,075 | A * | 9/1999 | Clarke et al. | 428/66.2 |
| 6,248,417 | B1 | 6/2001 | Ponsolle et al. | |
| 7,060,134 | B2 * | 6/2006 | Chang | 118/728 |
| 8,074,330 | B2 | 12/2011 | Lecostaouec | |
| 2010/0056005 | A1 | 3/2010 | Okada | |
| 2011/0097526 | A1 | 4/2011 | Goering | |
| 2011/0275266 | A1 | 11/2011 | Lecostaouec | |

FOREIGN PATENT DOCUMENTS

| | | |
|---|---|---|
| FR | 646341 | 11/1928 |
| FR | 2490687 | 3/1982 |
| FR | 2643656 | 2/1989 |
| FR | 2682402 | 4/1993 |
| WO | 0050676 | 8/2000 |

OTHER PUBLICATIONS

Exam Report dated Aug. 13, 2014 in European Application No. 13157695.1.

Extended Search Report dated May 6, 2013 in European Application No. 13157695.1.

Examination Report dated May 29, 2015 in European Application No. 13157695.1.

* cited by examiner

SYSTEMS AND METHODS FOR REDUCED CRIMP CARBON FIBER HELICAL FABRIC

FIELD OF INVENTION

This disclosure is generally related to methods, apparatus and manufacturing associated with reduced crimp woven fabrics and, in particular, helical carbon fiber woven fabric.

BACKGROUND OF THE INVENTION

Carbon/carbon ("C/C") parts are employed in various industries. C/C parts may be used as, for example, friction disks such as aircraft brake disks, race car brake disks, clutch disks, and the like. C/C brake disks are especially useful in such applications because of the superior high temperature characteristics of C/C material. In particular, the C/C material used in CC parts is a good conductor of heat, and thus is able to dissipate heat away from the braking surfaces that is generated in response to braking. C/C material is also highly resistant to heat damage, and is capable of sustaining friction between brake surfaces during severe braking, without a significant reduction in the friction coefficient or mechanical failure. Ceramic Matrix Composites (CMCs) exhibit useful thermal and mechanical properties and hold the promise of being outstanding materials for use in high temperature environments and/or in heat sink applications. Ceramic Matrix Composites generally comprise one or more ceramic materials disposed on or within another material, such as, for example, a ceramic material disposed within a structure comprised of a fibrous material. Fibrous materials, such as carbon fiber, may be formed into fibrous structures suitable for this purpose.

C/C material and/or CMCs are generally formed using a precursor fiber, such as continuous oxidized polyacrylonitrile (PAN) fibers, referred to as "OFF" fibers. OPF fibers are precursors of carbonized PAN fibers and are used to fabricate a preformed shape, formed by, for example, laying out fiber tows along several fiber orientations followed by a series of needling steps. Typically, two or more layers of fibers are layered onto a support and are then needled together simultaneously or in a series of needling steps. This process interconnects the horizontal fibers with a third direction also called the z-direction, and the fibers extending into the third direction are also called z-fibers. This needling process may involve driving a multitude of barbed needles into the fibrous layers to displace a portion of the horizontal fibers into the z-direction.

One current approach used to prepare fibrous preform structures for manufacturing carbon-carbon brake disks is to needle punch layers of OPF fibers in a board shape from which donut shape preforms may be cut. The preforms are subsequently subjected to a costly carbonization cycle to transform the fibers into carbon. This approach yields a large amount of fiber waste and has limitations in fiber selection and fiber architecture designs. A more effective method to fabricate the fibrous preform structure is to organize carbonized fibers in a continuous handleable helically formed fabric prepared with a suitable fiber architecture. The helical carbon fiber fabric is subsequently fed into a circular needle punch machine to prepare a near net shape three dimensional textile. The various carbon fiber tows of the fabric may be interlaced using weaving.

Weaving typically yields fabrics with undesired fiber crimp levels in both warp and weft directions, especially in a weave pattern such as plain weave. For a given weave pattern and tow size, the amount of crimp increases with the areal weight of the fabric. The crimp present in the starting fabric degrades the in plane mechanical and thermal properties of the finished carbon carbon composite. Accordingly, there is a need for developing systems and methods for the production of fabrics exhibiting reduced crimp.

SUMMARY

Systems and methods for reduced crimp fabrics are provided herein. In various embodiments, systems and methods for weaving helical carbon fabrics for preparing near net shape annular preforms with minimum fiber crimp are provided herein. In various embodiments, one may use small denier natural or synthetic yarns in the warp direction to interlace the carbon fiber wefts with minimum deformation. These yarns (also referred to herein as interlocking yarns) may have a much smaller cross section than the primary well and warp carbon fiber tows, thus limiting their load on the primary fibers during weaving. Specific weave constructions combined with the use of small tex yarns to maintain the fiber architecture in place may tend to result in low crimp well and warp carbon fibers. The interlocking yarn, preferably a fiber burning cleanly during the heat treatment and densification steps of the preform, may provide the integrity of the fabric during a post weaving step preceding the needling operation.

For example, in various embodiments, a textile is provided comprising a first interlocking warp yarn, a first weft tow, a second well tow, and a first primary warp tow, wherein the first primary warp tow passes below the first well tow and above the second well tow, and wherein the first interlocking warp yarn passes above the first well tow and below the second well tow.

In various embodiments, a method is provided comprising placing a first primary warp tow and a first interlocking warp yarn on a weaving device, disposing a first well tow above the first primary warp tow and below the first interlocking war fiber, and disposing a second well tow below the first primary warp tow and above the first interlocking warp fiber.

BRIEF DESCRIPTION OF THE DRAWINGS

The systems and/or methods disclosed herein may be better understood with reference to the following drawing figures and description. Non-limiting and non-exhaustive descriptions are described with reference to the following drawing figures. The components in the figures are not necessarily to scale, emphasis instead being placed upon illustrating principles. In the figures, like referenced numerals may refer to like parts throughout the different figures unless otherwise specified. Further, because the disclosed fibers and yarns (and their orientations) in practice are very small and closely packed, the figures herein may show exaggerated fiber width and spacing in order to more clearly illustrate the fiber orientations.

DETAILED DESCRIPTION

Figures 1A, 1B:
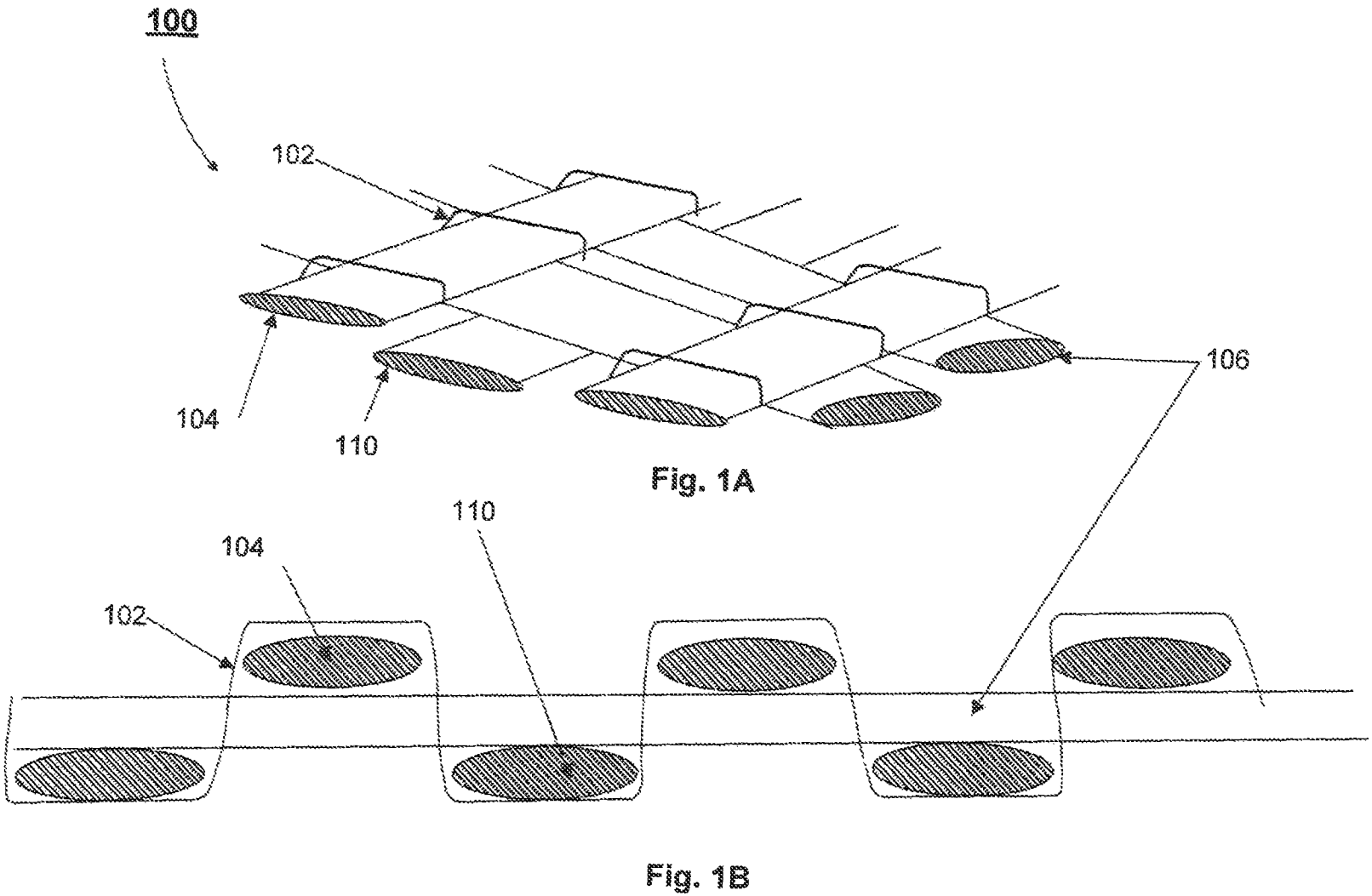
FIGS. 1A, 1B and 1C illustrate a textile in accordance with various embodiments.

The detailed description of various embodiments herein makes reference to the accompanying drawing figures, which show various embodiments and implementations thereof by way of illustration and its best mode, and not of limitation. While these embodiments are described in sufficient detail to enable those skilled in the art to practice the embodiments, it should be understood that other embodiments may be realized and that logical, electrical, and mechanical changes may be made without departing from the spirit and scope of the invention. Furthermore, any reference to singular includes plural embodiments, and any reference to more than one component or step may include a singular embodiment or step.

Also, any reference to attached, fixed, connected or the like may include permanent, removable, temporary, partial, full and/or any other possible attachment option. Additionally, any reference to without contact (or similar phrases) may also include reduced contact or minimal contact. Finally, though the various embodiments discussed herein may be carried out in the context of an aircraft brake material or clutch, it should be understood that systems and methods disclosed herein may be incorporated into anything needing a brake, a clutch, or having a wheel, or into any vehicle such as, for example, an aircraft, a train, a bus, an automobile and the like.

Various embodiments of the disclosed system and method will now be described with reference to the appended figures, in which like reference labels are used to refer to like components throughout. The appended figures are not necessarily to scale. As used herein, the singular forms "a," "an," and "the" include plural referents unless the context clearly dictates otherwise. As used herein, the terms "for example," "for instance," "such as," or "including" are meant to introduce examples that further clarify more general subject matter. Unless otherwise specified, these examples are present disclosure, and are not meant to be limiting in any fashion.

As used herein, the terms "tow" and "cable" are used to refer to one or more strands of substantially continuous filaments. Thus, a "tow" or "cable" may refer to a plurality of strands of substantially continuous filaments or a single strand of substantially continuous filament. "Helical" fabric may also be referred to herein as "spiral" fabric, A "textile" may be referred to as a "fabric" or a "tape." A "loom" may refer to any weaving device.

As used herein, the term "yarn" may refer to a spun short length fiber. A yarn may be used in connection with the interlocking yarn, discussed in detail herein. An interlocking yarn's size may be given in denier or tex. In various embodiments, interlocking yarns may be of size from about 30 tex to about 300 tex. The size of the interlocking yarn may be based at least in part on the size of carbon fiber tow.

As used herein, the unit "K" represents "thousand." Thus, a 1K tow means a tow comprising about 1,000 strands of substantially continuous filaments. For example, a "heavy tow" may comprise about 48,000 (48K) textile fibers in a single tow, whereas a "medium tow" may comprise about 24,000 (24K) textile fibers within a single tow whereas a "lighter tow" may comprise about 6,000 (6K) textile fibers within a single tow. Fewer or greater amounts of textile fibers may be used per cable in various embodiments. In various embodiments disclosed herein, fabrics in accordance with various embodiments may comprise tows of from about 1K to about 100K, and, in various embodiments, heavier tows. As is understood, "warp" fibers are fibers that lie in the "warp" direction in the textile—i.e., along the length of the textile, "Weft" fibers are fibers that lie in the "weft" direction in the textile—i.e., along the width of the textile. Warp fibers may be described as being spaced apart with respect to the weft direction (i.e., spaced apart between the outer diameter (OD) and inner diameter (ID) of the textile). Similarly, the well tows may be described as being spaced apart with respect to the warp direction.

In various embodiments, any combination of carbon fiber warp and well tow size may be used. For example, 48 k warp tows may be used with 24 k well tows. Also for example, other combinations of warp tows to weft tows include: 48K:12K, 24K:24K, and 24K:12K.

According to various embodiments, any textile comprised of fibers is contemplated herein. For example, types of textile fibers may include carb©n fiber precursor fibers such as oxidized polyacrylonitrile (PAN) fibers, carbonized PAN fibers, stabilized pitch fibers, substantially pure carbon fibers or other suitable materials may be used. Generally, carbon fibers having above about 90 wt % carbon composition may be considered to be pure or substantially pure carbon fibers. Carbon fibers having a composition of carbon below about 90 wt % may be pre-carbonized or fully carbonized carbon fibers. Both types of carbon fibers may be used according to various embodiments. Interlocking yarns, as described below, may comprise the aforementioned fibers and may further comprise other fibers such as cotton, wool, linen, polyester, silk, nylon, rayon, polypropylene, acrylic, and other synthetic or natural fibers that may burn completely or substantially completely.

Textiles in accordance with various embodiments may be layered or otherwise coupled and be subjected to needling in a z direction. According to various embodiments, needled textiles may be heated to transform the textile into carbon fiber. Transformation of carbon fiber body precursors, such as PAN fibers, often occurs in a two stage process. The first stage may be a carbonization stage. A carbonization stage is typically performed at temperatures of less than 1100° C., and most typically between about 800° C. and 950° C. The second stage may be a high temperature stage, typically using temperatures over 1400° C.

The transformed textile may then be densified using chemical vapor deposition (CVD) and/or chemical vapor infiltration (CVI). The densification process may deposit carbon and/or a ceramic material (e.g., silicon carbide (SiC)) within the textile.

Textiles (as described herein) may be formed into annular configuration, for example, a ring configuration. An annular configuration may comprise an outer diameter (OD) representing the outermost diameter of the textile and an inner diameter (ID) representing the innermost diameter of the textile. The ID and OD of an annular configuration textile may be used as reference points for the orientation of various yarns.

As discussed above, the introduction of crimp in fiber tows at various warp weft interlacings tends to be detrimental to the performance of various textiles, such as those that are used to create densified parts such as carbon/carbon composites. Crimp is especially pronounced when patterns such as plain weave are used to create a high areal weight fabric with a small carbon fiber tow. Crimp may be reduced but not eliminated by weaving a lighter weight fabric with a satin type pattern. In particular, significant levels of crimp may impact the in-plane thereto-mechanical properties of the final carbon carbon composite. In-plane thermo-mechanical properties of may be improved by reducing crimp in the carbonized or pre-carbonized textile.

In addition to enhanced mechanical and thermal properties in the finished composite, layers of un-crimped fabric nest better during the needling steps and are more likely to form smaller porosity within the preform than fabric woven with a high amount of crimp. Large voids in a textile may lead to increased porosity of a final, densified carbon/carbon composite. However, tighter weaves interlaced with tows larger than 12K are more likely to present large voids.

It has been discovered that the use of properly located small tex/denier interlocking yarns or threads in specific weave constructions may reduce or eliminate the crimp in the warp and weft primary carbon fiber tows. In various embodiments, one may use small tex/denier synthetic yarns in the warp direction to interlace carbon fiber wefts with minimum deformation. These yarns, also referred to herein as interlocking yarns, have a much smaller cross section than the primary weft and warp carbon fiber tows, thus limiting their load on the primary fibers during weaving. Specific weave constructions combined with the use of small denier yarns to maintain the fiber architecture in place result in low crimp weft and warp carbon fibers. The interlocking yarn, preferably a fiber burning cleanly during the heat treatment and densification steps of the preform, provides the integrity of the fabric during the post weaving step preceding the needling operation.

In various embodiments, a interlocking yarn may run parallel or substantially parallel to one or more warp tows and, in various embodiments, the warp tows may be secured by alternating weft tows.

The phrase primary warp tows may mean warp tows that are not the interlocking yarn. The interlocking yarn, in various embodiments, may have a smaller cross section of diameter than the cross section of diameter of a primary warp tow. For example, an interlocking yarn may comprise a 40 denier cotton yarn and a primary warp tow may be from about 6 k to about 50 k.

The selection of interlocking yarn diameter is based in part upon the properties of the interlocking yarn (e.g., tensile strength) and the diameter of the primary warp tows and/or well tows. Higher tensile strength interlocking yarns may be used in smaller diameters than lower tensile strength interlocking yarns. Higher tensile strength interlocking yarns may be especially advantageous when used in conjunction with larger diameter primary warp tows and/or weft tows. In various embodiments, it may be especially advantageous to use smaller diameter interlocking yarns that exhibit sufficient tensile strength, for example, in embodiments having a sacrificial interlocking yarn. In this regard, the space left after the disintegration of the interlocking yarn will be smaller than if a larger diameter interlocking yarn was used.

The use of small diameter interlocking yarn in the warp direction provides a mechanism to secure the weft and warp tows in place without causing deformation to the weft tows. In various embodiments, the weave patterns are selected to create a three layer textile where the warp tows are secured by alternating outside weft tows. As described above, textiles in accordance with various embodiments minimize or eliminate crimp in both weft and warp directions.

In various embodiments, a interlocking yarn may be sacrificial. Stated another way, the interlocking yarn may comprise a material that will substantially disintegrate upon during the high temperature steps of the heat treatment or densification operations of the textile. As discussed above, carbonization involves heating to high temperatures to convert carbon fiber precursors into carbon fiber. In this manner, the interlocking yarn tends to reduce crimp during the manufacture of the textile and is thus removed prior to densification. In various embodiments, sacrificial interlocking yarns and/or specific weave construction yield straight in-plane carbon fiber tows facilitate fabric layers nesting during the needling step, thus providing smaller pore size and better densification. For example, cotton thread may be used as a sacrificial interlocking yarn. Cotton will substantially disintegrate (e.g., burn or carbonize) at temperatures typically associated with carbonization or temperatures leading to the beginning of densification through chemical vapor deposition or like process. Other natural fibers may be used as a sacrificial interlocking yarn such as wool, linen and silk. Typically, synthetic fibers, such as nylon, rayon, polypropylene, acrylic, and aramids (meta aramids like NOMEX or para-aramids like KEVLAR) may be used as an interlocking yarn, but such materials may leave undesirable residue in the finished composites.

Alternating well tows may comprise a first well tow that passes above a primary warp tow and a second well tow that passes below the primary warp tow. In various embodiments, the first well tow and the second weft tow may pass over the interlocking yarn in a manner inverse to the pattern that the first well tow and the second weft tow pass over the primary warp tow. Stated another way, in embodiments where a first well tow passes above a primary warp tow and a second well tow passes below the primary warp tow, the first well tow may pass below the interlocking yarn and the second well tow may pass above the interlocking yarn.

With reference to FIGS. 1A and 1B, textile 100 is shown in accordance with various embodiments. Interlocking yarn 102 is shown extending in the warp direction. Primary warp tow 106 is also shown extending in the warp direction. First well tow 104 and second well tow 110 are shown in a well direction. As shown, first well tow 104 passes above primary warp tow 106 and second well tow 110 passes below primary warp tow 106. Also as shown, interlocking yarn 102 passes above first well tow 104 and interlocking yarn 102 passes below second well tow 110. The terms "above" and "below" as used herein may mean adjacent to portions of a surface of a tow that are about 180 degrees apart. Stated another way, as shown in FIG. 1B, first well tow 104 is adjacent to a surface of primary warp tow 106 that is about 180 degrees from the surface of primary warp tow 106 that is adjacent to second well tow 110, it is noted that first well tow 104 and second well tow 110 are spaced apart in a warp direction.

As shown in FIGS. 1A and 1B, the weft tows may alternate with respect to primary warp tow in a one to one ratio. However, in various embodiments, there may be any suitable ratio of weft tows to warp tows. In various embodiments, well tow groups may be configured above and below a primary warp tow in any suitable ratio. Well tow groups may be arranged both symmetrically and asymmetrically about a primary warp tow.

Figure 1C:
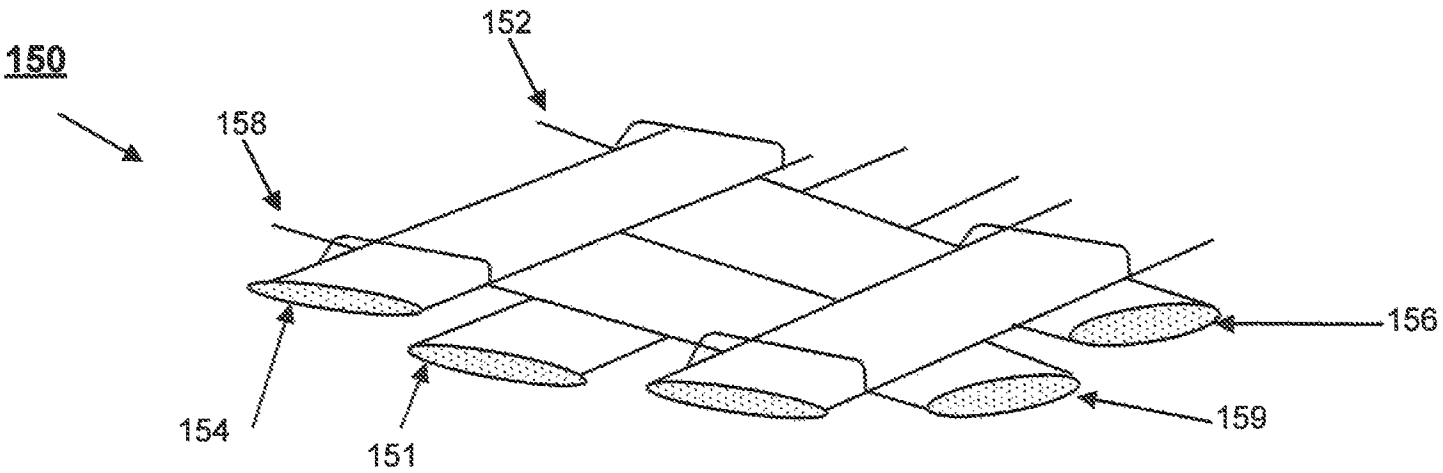

With reference to FIG. 1C, textile 150 is shown in accordance with various embodiments. Interlocking yarns 152 and 158 are shown extending in the warp direction. Primary warp tows 156 and 159 are also shown extending in the warp direction. First well tow 154 and second weft tow 151 are shown in a well direction. As shown, first well tow 154 passes above primary warp tow 156 and second weft tow 151 passes below primary warp tow 156. Also as shown, interlocking yarn 152 passes above first well tow 154 and interlocking yarn 152 passes below second well tow 151. Interlocking yarns 152 and 158 are spaced every two primary warp tows (shown in FIG. 1C as primary warp tows 156 and 159) in a repeating patterns. As described herein, interlocking warp yarns may be repeated any suitable number of primary warp tows, such as every one, two, three, four, five, six, or seven primary warp tows.

Figures 2A, 2B:
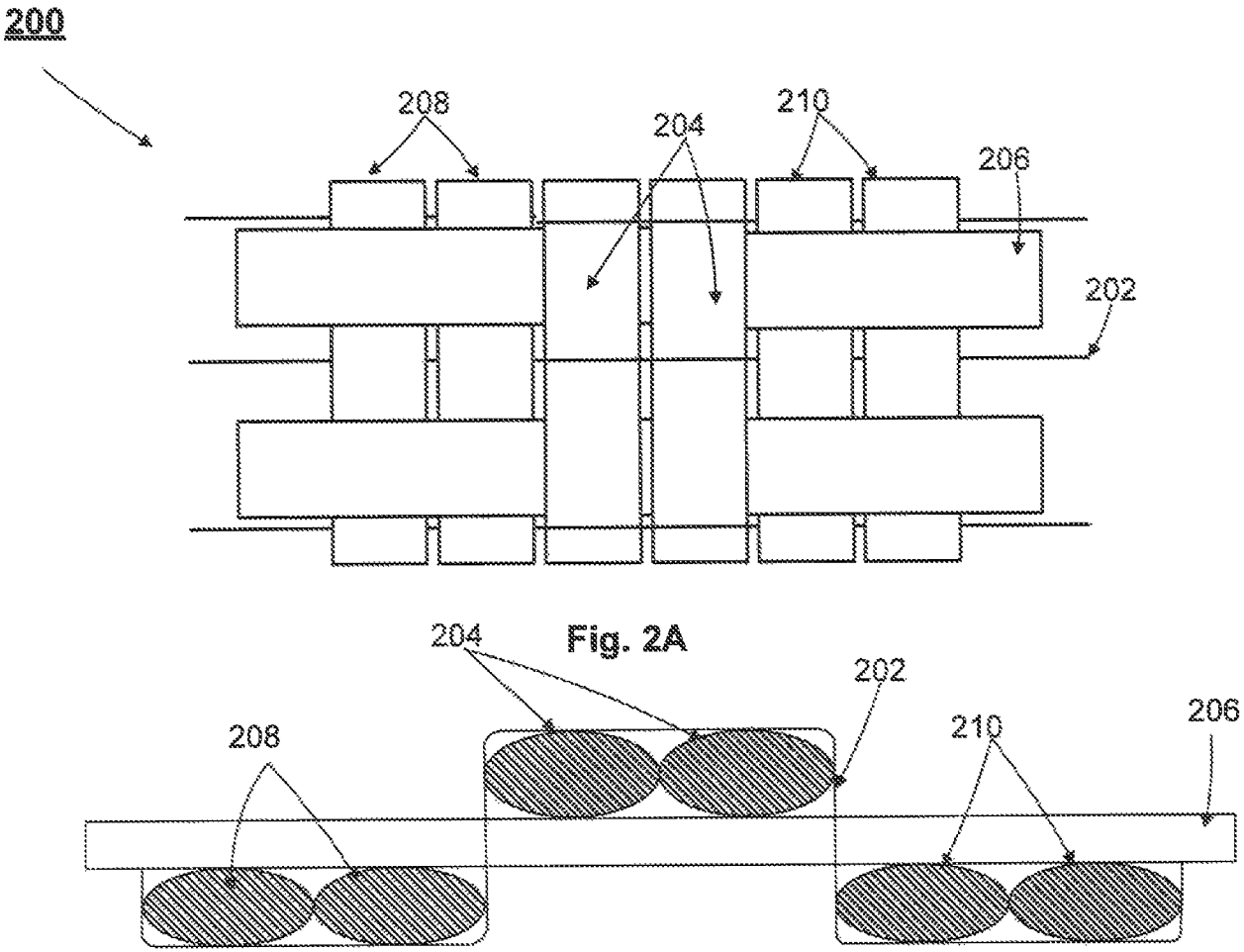
FIGS. 2A and 2B illustrate a further textile in accordance with various embodiments.

For example, with reference to FIGS. 2A and 213, textile 200 comprises primary warp tow 206 with interlocking yarn 202. Three well tow groups are illustrated: well tow group 208, well tow group 204 and well tow group 210. Weft tow group 208 is disposed below primary warp tow 206. Adjacent to well tow group 208 in a warp direction is well tow group 204. Well tow group 204 is disposed above primary warp tow 206 (i.e., on a surface of primary warp tow 206 that is about one hundred eighty degrees apart from well tow group 208). Well tow group 210 is disposed below primary warp tow 206. Textile 200 thus has a ratio of 2 tows beneath a primary warp tow to 2 tows above a primary warp tow, arranged in an alternating pattern. Interlocking yarn 202 is disposed below well tow group 208, above well tow group 204 and below well tow group 210.

Figure 3A:
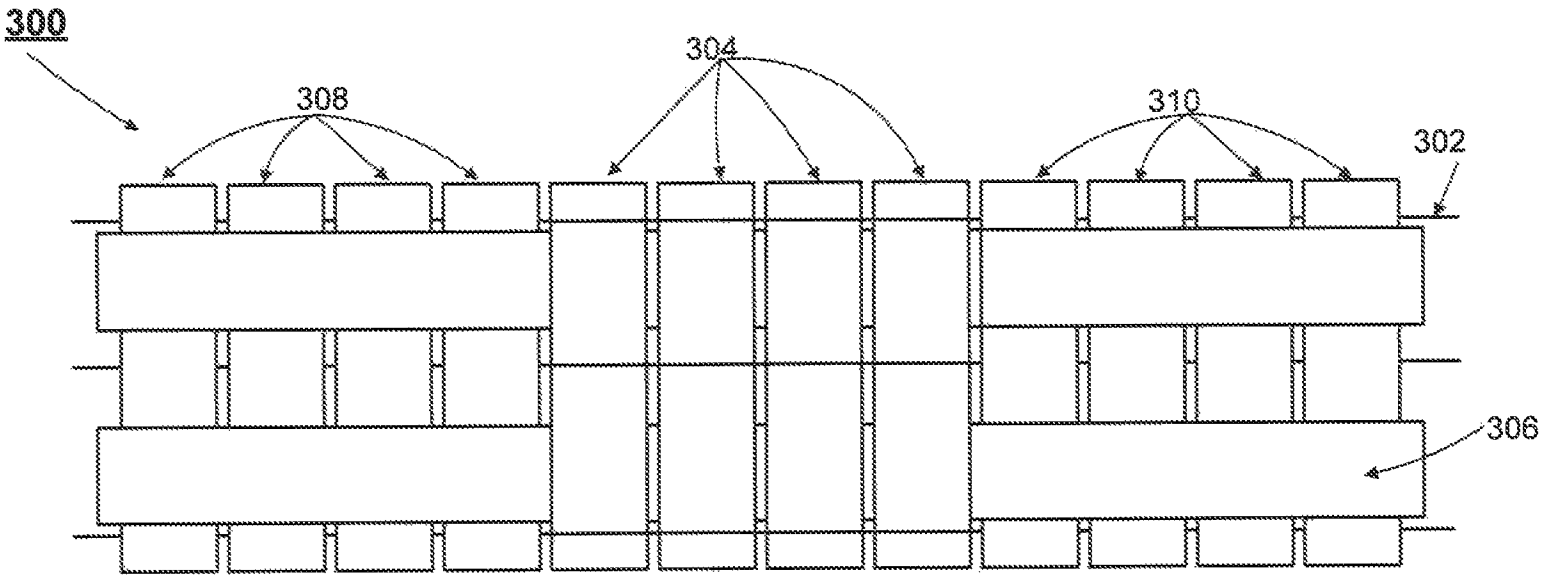
FIGS. 3A and 3B illustrate an additional textile in accordance with various embodiments.
Figure 3B:
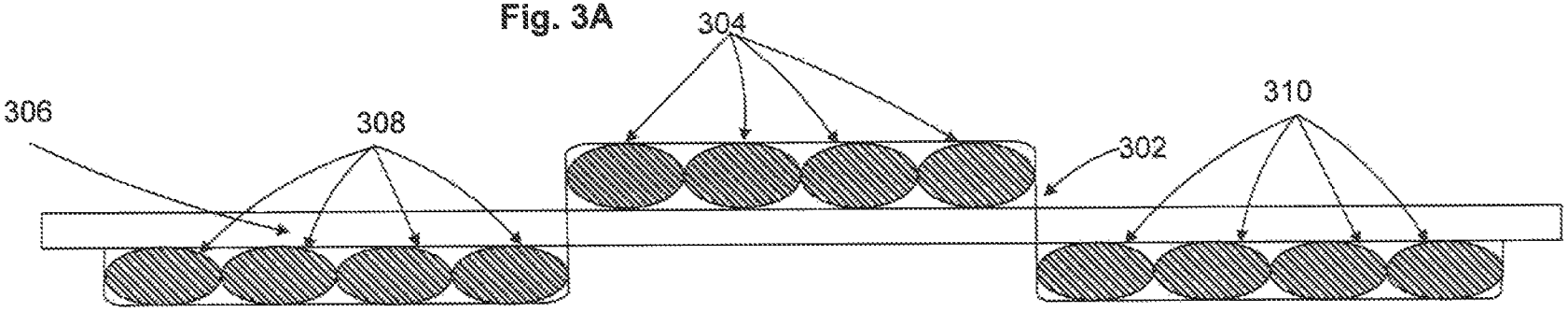

Also for example, with reference to FIGS. 3A and 3B, textile 300 comprises primary warp tow 306 with interlocking yarn 302. Three well tow groups are illustrated: well tow group 308, weft tow group 304 and well tow group 310. Well tow group 308 is disposed below primary warp tow 306. Adjacent to well tow group 308 in a warp direction is weft tow group 304. Well tow group 304 is disposed above primary warp tow 306 (i.e., on a surface of primary warp tow 306 that is about one hundred eighty degrees apart from well tow group 308). Well tow group 310 is disposed below primary warp tow 306. Textile 300 thus has a ratio of 4 tows beneath a primary warp tow to 4 tows above a primary warp tow, arranged in an alternating pattern. Interlocking yarn 302 is disposed below weft tow group 308, above well tow group 304 and below well tow group 310.

Figure 4A:
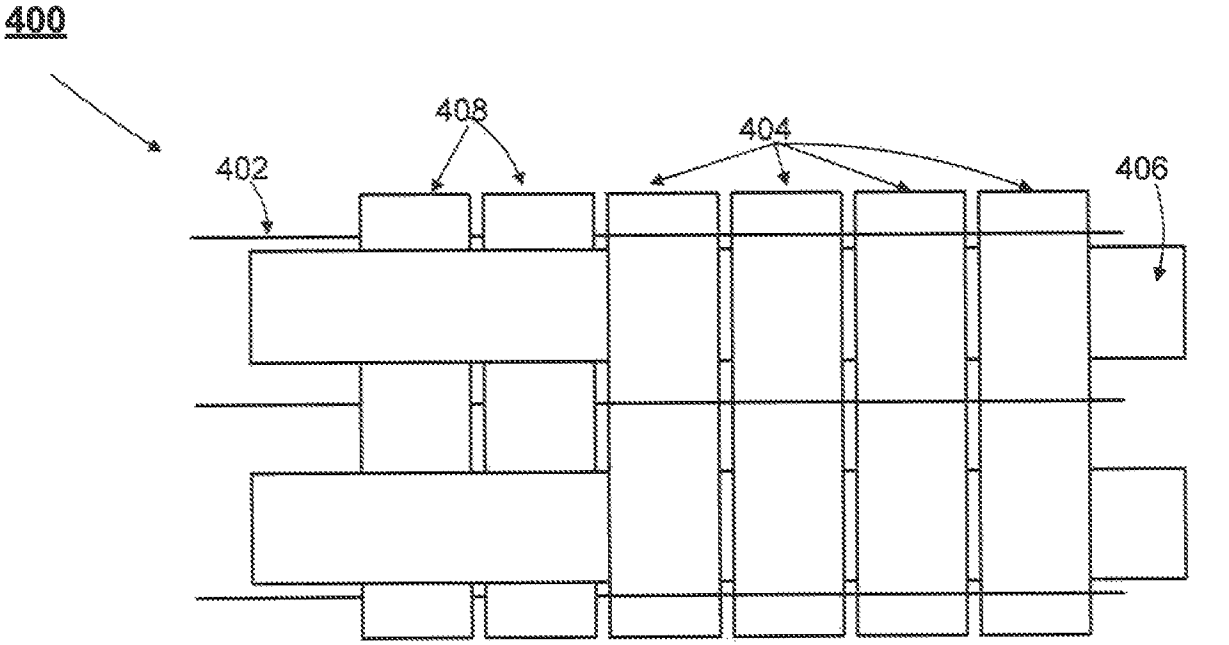
FIGS. 4A and 4B illustrate a further textile in accordance with various embodiments.
Figure 4B:
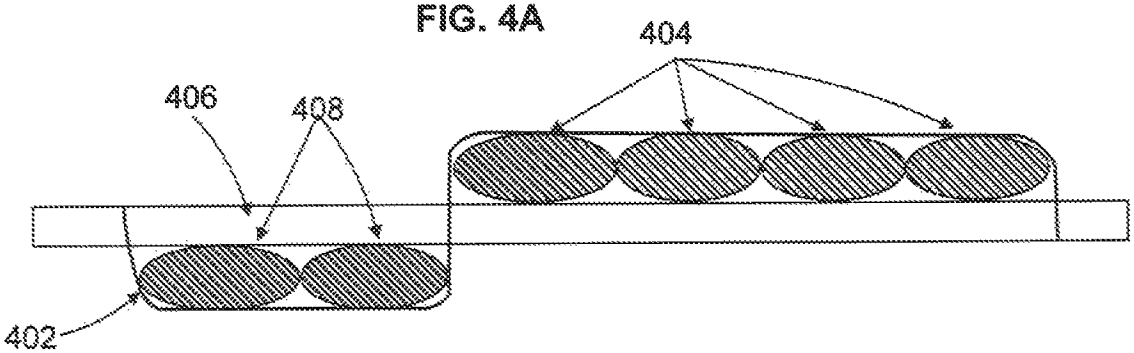

As discussed above, well tows may be arranged asymmetrically about a primary warp tow. For example, with reference to FIGS. 4A and 413, textile 400 comprises primary warp tow 406 with interlocking yarn 402. Two well tow groups are illustrated: well tow group 408 and weft tow group 404. Weft tow group 408 is disposed below primary warp tow 406. Adjacent to well tow group 408 in a warp direction is well tow group 404. Weft tow group 404 is disposed above primary warp tow 406 (i.e., on a surface of primary warp tow 406 that is about one hundred eighty degrees apart from well tow group 408). Textile 400 thus has a ratio of 2 tows beneath a primary warp tow to 4 tows above a primary warp tow, arranged in an alternating pattern. Interlocking yarn 402 is disposed below well tow group 408 and above well tow group 404.

Textiles in accordance with various embodiments may be manufactured in any suitable manner. In various embodiments, a textile may be manufactured by placing a first primary warp tow and a first interlocking warp yarn on a weaving device, disposing a first weft tow above the first primary warp tow and below the first interlocking warp fiber, and disposing a second weft tow below the first primary warp tow and above the first interlocking warp fiber. As discussed above, any type of weave is contemplated herein, though a plain weave offers a very good primary carbon fiber stability during various handling steps.

For example a weaving loom equipped with a set of conical take-off rollers to shape the fabric (e.g., impart the geometry to the textile) may be used. Shedding motions of the primary carbon fiber warp tows and of the interlocking warp yarns are controlled in groups through heddles frames or individually through a jacquard head. The weft carbon tow is introduced in the shed to produce a specific weave pattern. The helical fabric is laid down in a circular needle-punch loom and needled into a near net shape annular preforms ready for densification or carbonization.

EXAMPLE

One high areal weight helical carbon fabric showing no evidence of fiber crimp was fabricated with the proposed invention. The 1400 g/m2 fabric was prepared with a plain weave pattern alternating every other primary warp carbon fiber tow with a cotton yarn. The warp carbon fiber was a 48K tow and the interlocking yarn was a 40 denier cotton yarn. The fabric handled very well during packaging steps and feeding into a circular needle-punch loom where several near net shape preforms were fabricated.

Additionally, benefits, other advantages, and solutions to problems have been described herein with regard to various embodiments. However, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A textile, comprising:

a first interlocking warp yarn;

a first weft tow;

a second weft tow; and a first primary warp tow, wherein the first weft tow, the second weft tow, and the first primary warp tow comprise a carbon fiber precursor, wherein the first primary warp tow comprises from about 6 thousand (K) to 50 K fibers, wherein the first weft tow comprises from about 6 K to 50 K fibers, wherein the second weft tow comprises from about 6 K to 50 K fibers, wherein the first primary warp tow passes below the first weft tow and above the second weft tow, wherein the first interlocking warp yarn passes above the first weft tow and below the second weft tow, wherein the first interlocking warp yarn is adjacent to the first primary warp tow in a warp direction, wherein the first interlocking warp yarn has a diameter that is less than the diameter of the first primary warp tow, wherein the first interlocking warp yarn is sacrificial and consists of at least one of cotton, wool, linen, polyester, silk, nylon, rayon, polypropylene, and acrylic.

2. The textile of claim 1, wherein the first interlocking warp yarn comprises a cotton yarn of denier of between about 10 denier to 100 denier.

3. The textile of claim 1, wherein the textile is an annular configuration having an inner diameter (ID) and an outer diameter (OD).

4. The textile of claim 3, wherein the first interlocking warp yarn is disposed closer to the OD than the first primary warp tow and wherein a second interlocking warp yarn is disposed closer to the ID than the first primary warp tow.

5. The textile of claim 3, wherein the first interlocking warp yarn is disposed closer to the OD than the first primary warp tow and wherein a second primary warp tow is disposed closer to the ID than the first primary warp tow.

6. The textile of claim 5, wherein a third primary warp tow is disposed closer to the ID than the second primary warp tow and wherein a second interlocking warp yarn is disposed closer to the ID than the third primary warp tow.

7. The textile of claim 1, further comprising a third weft tow, wherein the first primary warp tow passes below the third weft tow.

8. The textile of claim 7, further comprising a fourth weft tow, wherein the first primary warp tow passes above the fourth.

9. The textile of claim 1, wherein the first interlocking warp yarn comprises a 40 denier cotton yarn.

10. The textile of claim 1, wherein the first weft tow, the second weft tow, and the first primary warp tow consist of at least one of oxidized polyacrylonitrile (PAN) fibers, carbonized PAN fibers, or stabilized pitch fibers.

11. The textile of claim 1, wherein the first interlocking yarn runs at least one of parallel or substantially parallel to the first primary warp tow.

12. The textile of claim 10, wherein the first interlocking yarn runs at least one of parallel or substantially parallel to the first primary warp tow.

* * * * *